United States Patent [19]

Vornberger

[11] 3,962,741

[45] June 15, 1976

[54] HEEL AND SIDE LASTING MACHINE

[75] Inventor: Walter Vornberger, Tewksbury, Mass.

[73] Assignee: International Shoe Machine Corporation, Nashua, N.H.

[22] Filed: Mar. 27, 1975

[21] Appl. No.: 562,746

[52] U.S. Cl. ..... 12/10.5
[51] Int. Cl.[2] ..... A43D 21/00
[58] Field of Search ..... 12/8.1, 8.2, 10.1, 10.2, 12/10.5, 12

[56] References Cited

UNITED STATES PATENTS

| | | | |
|---|---|---|---|
| 2,117,331 | 5/1938 | Jorgensen | 12/8.2 |
| 2,357,841 | 9/1944 | Miller | 12/8.2 |
| 3,484,880 | 12/1969 | Bergeron | 12/10.5 |

*Primary Examiner*—Patrick D. Lawson
*Attorney, Agent, or Firm*—Albert Gordon

[57] ABSTRACT

A lasting machine for operating on a shoe assembly formed of a last having an upper mounted thereon and an insole located on its bottom having mechanism for wiping the heel and side portions of the margin of the upper against the insole.

2 Claims, 15 Drawing Figures

HEEL AND SIDE LASTING MACHINE

BACKGROUND OF THE INVENTION

Patent applications Ser. No. 467522 filed May 6, 1974 and Ser. No. 530927 filed Dec. 9, 1974 disclose a heel and side lasting machine that comprises heel wiping means, symmetrically disposed about a forwardly-rearwardly extending line of symmetry, mounted for forward movement from a retracted position to an advanced position in a heel wiping stroke. The machine includes support means for so supporting bottom-up a shoe assembly, formed of a last having an upper mounted thereon and an insole located on its bottom that the heel portion of the shoe assembly faces the heel wiping means and is located forwardly of the heel wiping means when the heel wiping means is in its retracted position whereby the heel wiping stroke causes the heel wiping means to wipe the heel portion of the upper margin against the insole. The support means is so movably mounted as to enable the heel portion of the shoe assembly to be swung transversely of the line of symmetry to thereby place the heel portion of a particular shoe assembly in symmetry with the line of symmetry.

A base is located outwardly of and on each side of the support means and a side lasting instrumentality is mounted to each base for inward-outward movement. Each side lasting instrumentality is so constructed as to enable it, when it is moved inwardly of an outer position on its associated base, to perform operations on its associated side portion of the shoe assembly that include engaging its associated side portion of the shoe assembly and wiping the margin of its associated side portion of the upper against the insole.

SUMMARY OF THE INVENTION

When the machine is operating on a left foot shoe assembly and the shoe assembly has been so supported on the support means that the heel portion of the shoe assembly is in symmetry with the line of symmetry, the right side shank portion of the shoe assembly diverges from the line of symmetry as this shank portion extends toewardly from the breast line on the right side of the shoe assembly and the left side shank portion of the shoe assembly is substantially parallel to the line of symmetry. When the machine is operating on a right foot shoe assembly and the shoe assembly is so supported on the support means that the heel portion of the shoe assembly is in symmetry with the line of symmetry, the left side shank portion of the shoe assembly diverges from the line of symmetry as this shank portion extends toewardly from the breast line on the left side of the shoe assembly and the right side shank portion of the shoe assembly is substantially parallel to the line of symmetry.

It is desirable that the side lasting instrumentalities be substantially parallel to their associated sides of the shoe assembly when they are moved inwardly of the outer positions on their bases to perform their operations and it is the object of this invention to provide a construction that enables the side lasting instrumentalities to assume this substantially parallel posture regardless of whether a left foot or a right foot shoe assembly is being operated on by the machine. To achieve this object each base is mounted for pivotal movement about an upright axis towards and away from the line of symmetry and each side lasting instrumentality is so mounted to its associated base as to extend forwardly of its associated axis. In addition, the machine incorporates moving means for swinging each base between a first position wherein its associated side lasting instrumentality extends forwardly and outwardly of its associated axis and a second position wherein its associated side lasting instrumentality so extends forwardly of its associated axis that it is located inwardly of its first position.

DESCRIPTION OF THE PREFERRED EMBODIMENT

Figure 1:
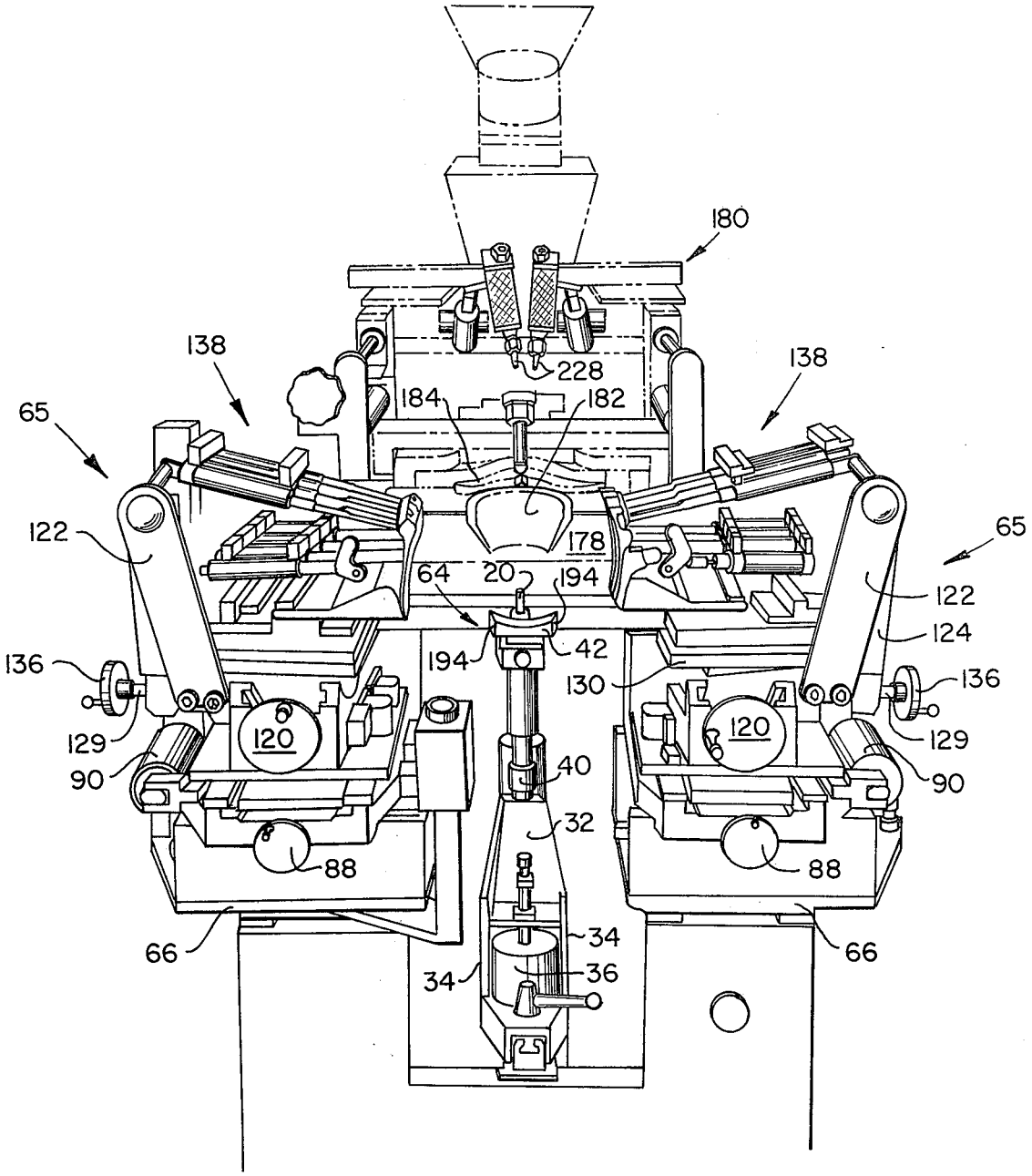
FIG. 1 is a front view of the machine.
Figure 2:
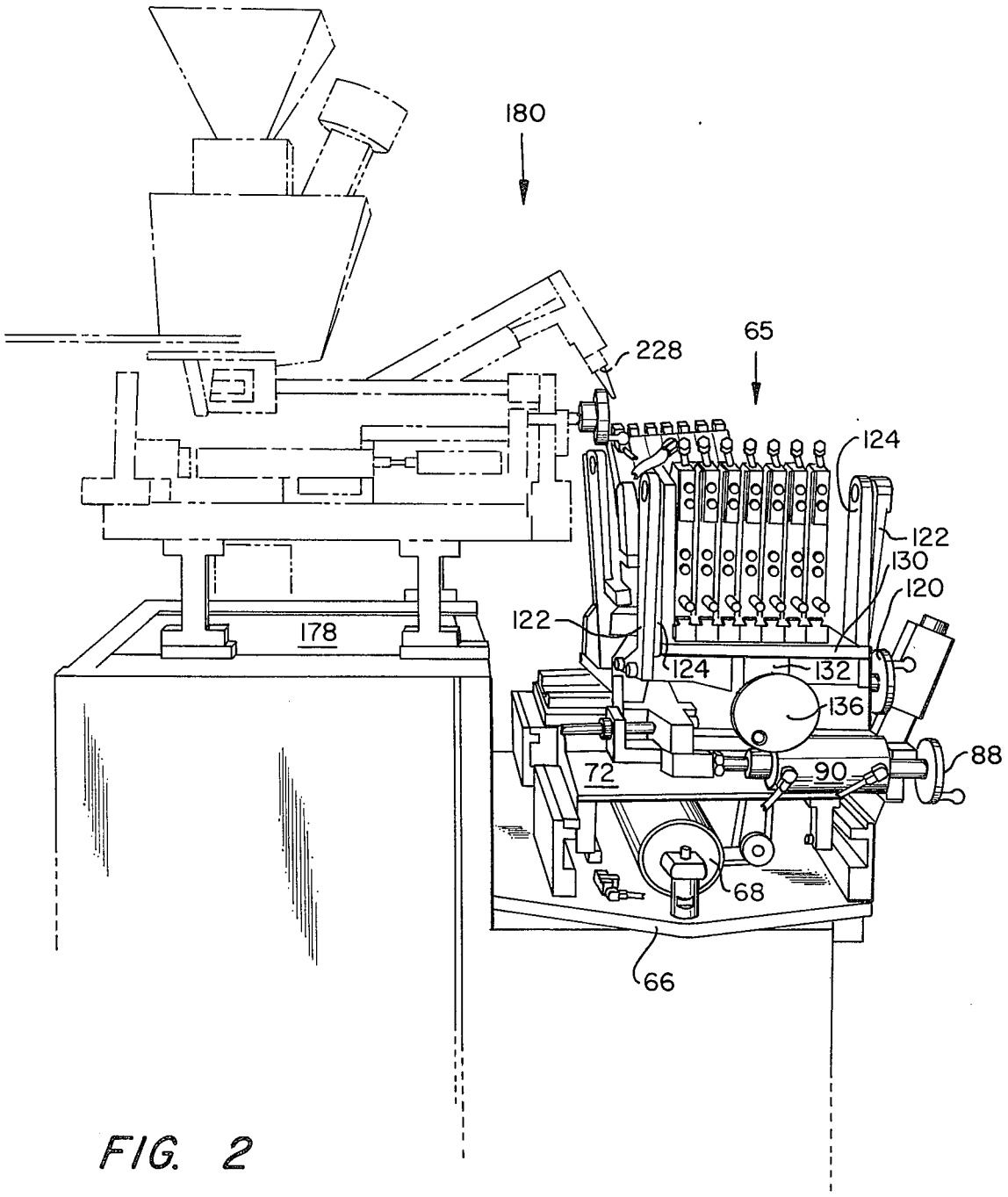
FIG. 2 is a side view of the machine.
Figure 3:
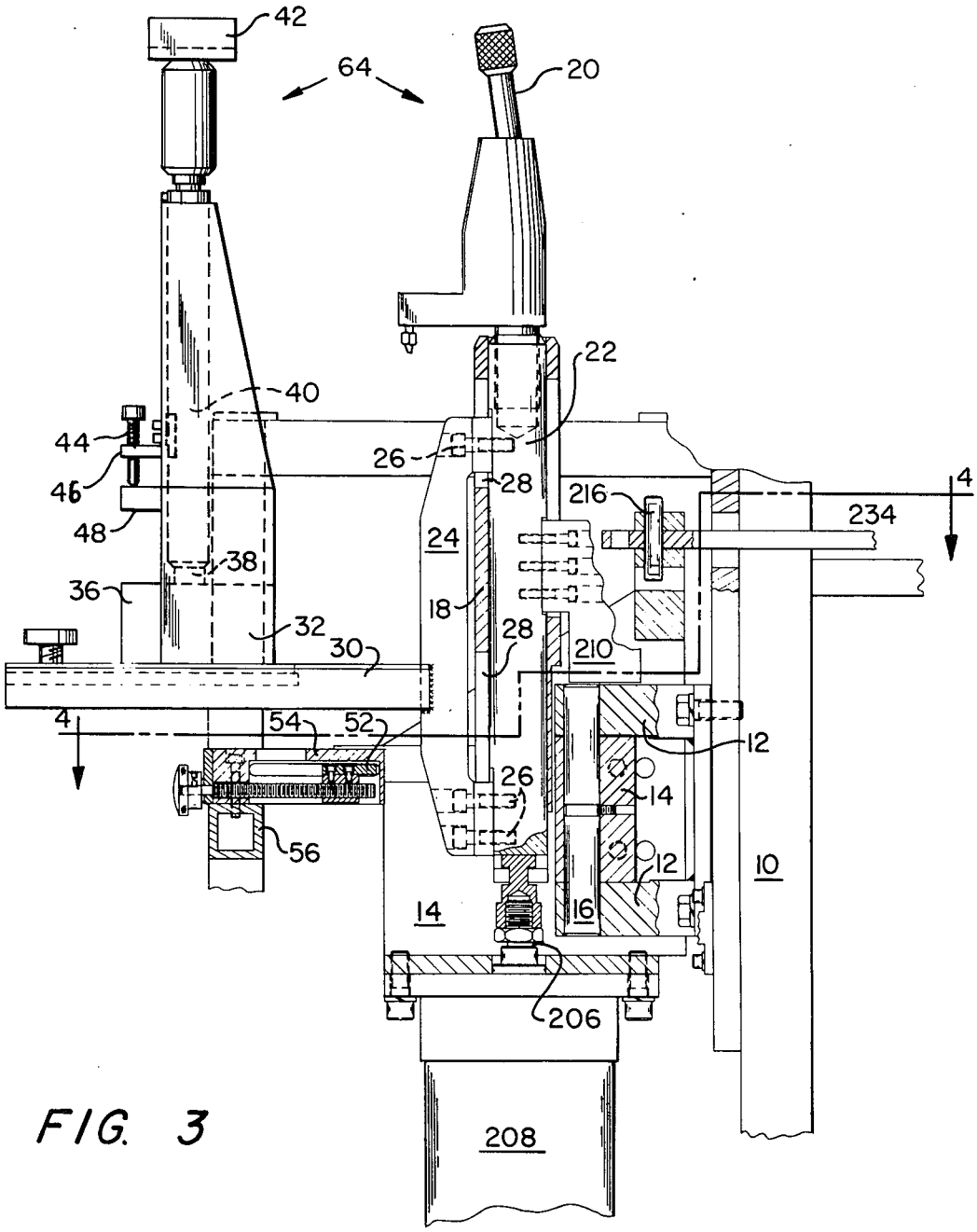
FIG. 3 is a partially sectional elevation of the support means.
Figure 4:
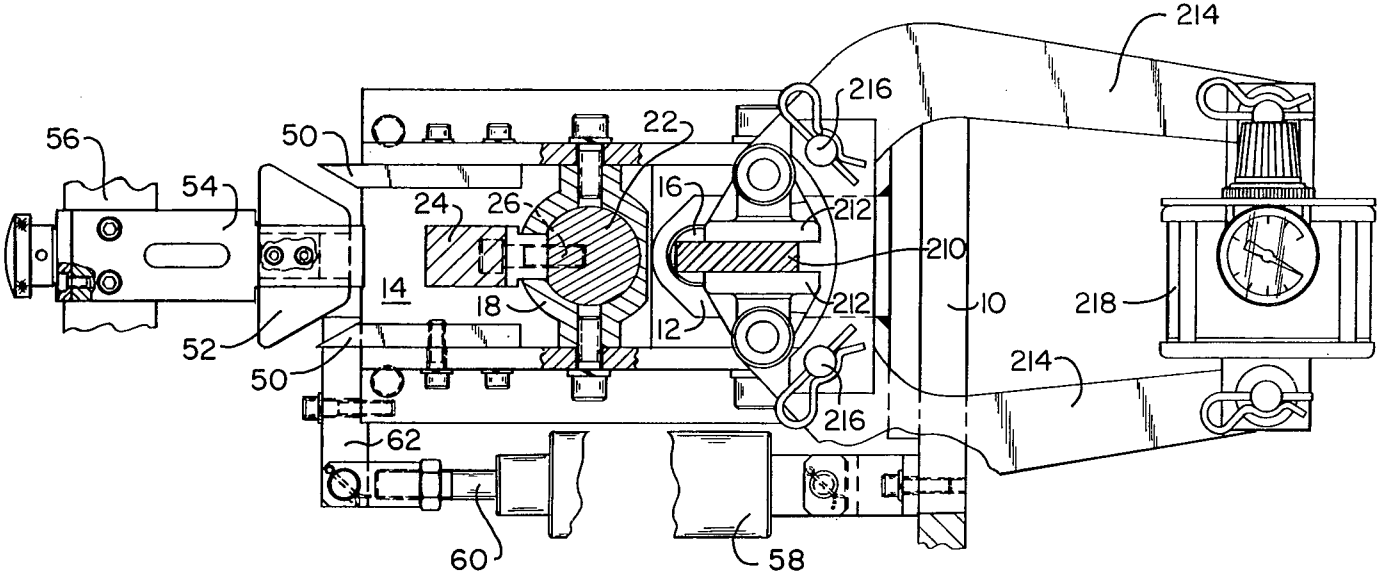
FIG. 4 is a view taken along the line 4—4 of FIG. 3.
Figure 5:
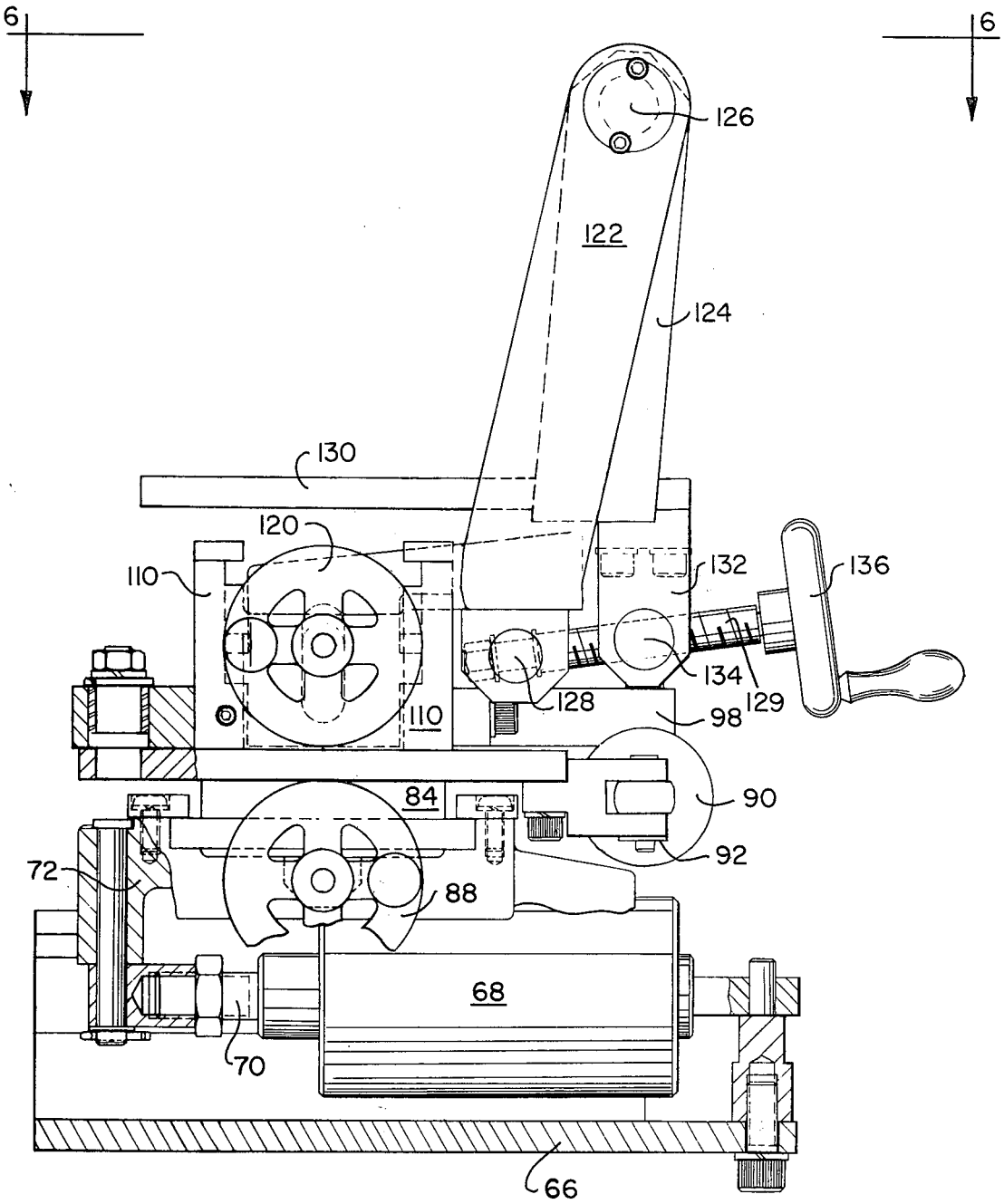
FIG. 5 is a side elevation of a base mounting.
Figure 6:
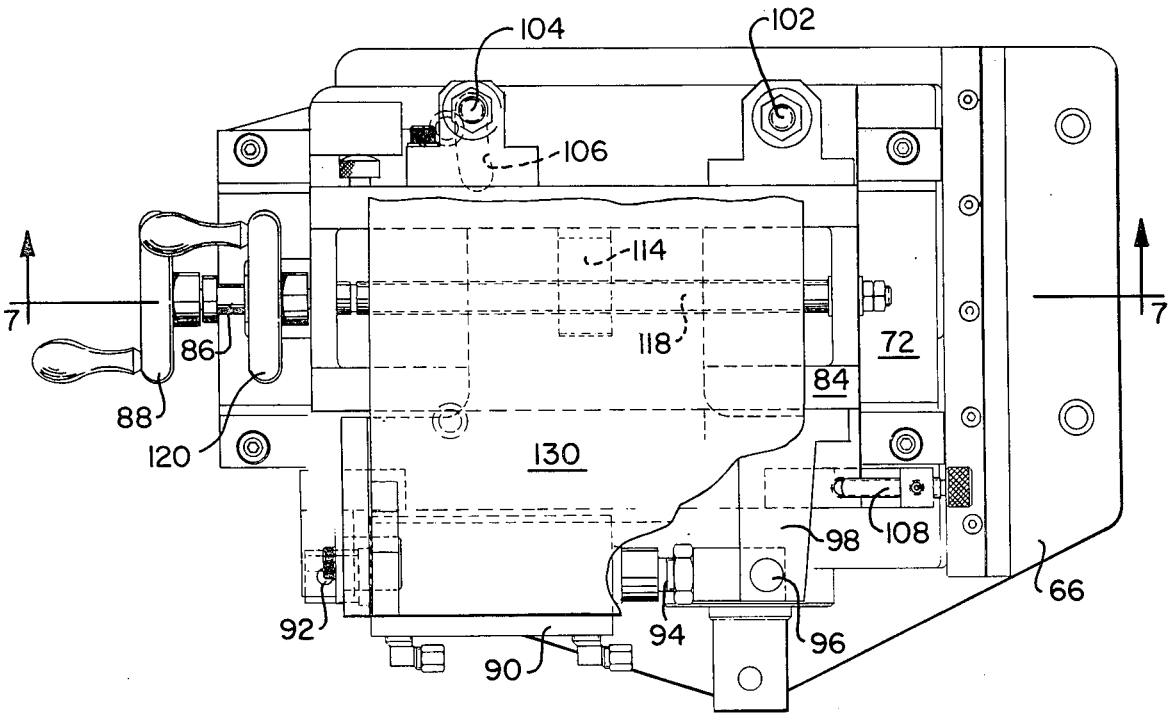
FIG. 6 is a plan view taken along the line 6—6 of FIG. 5.
Figure 7:
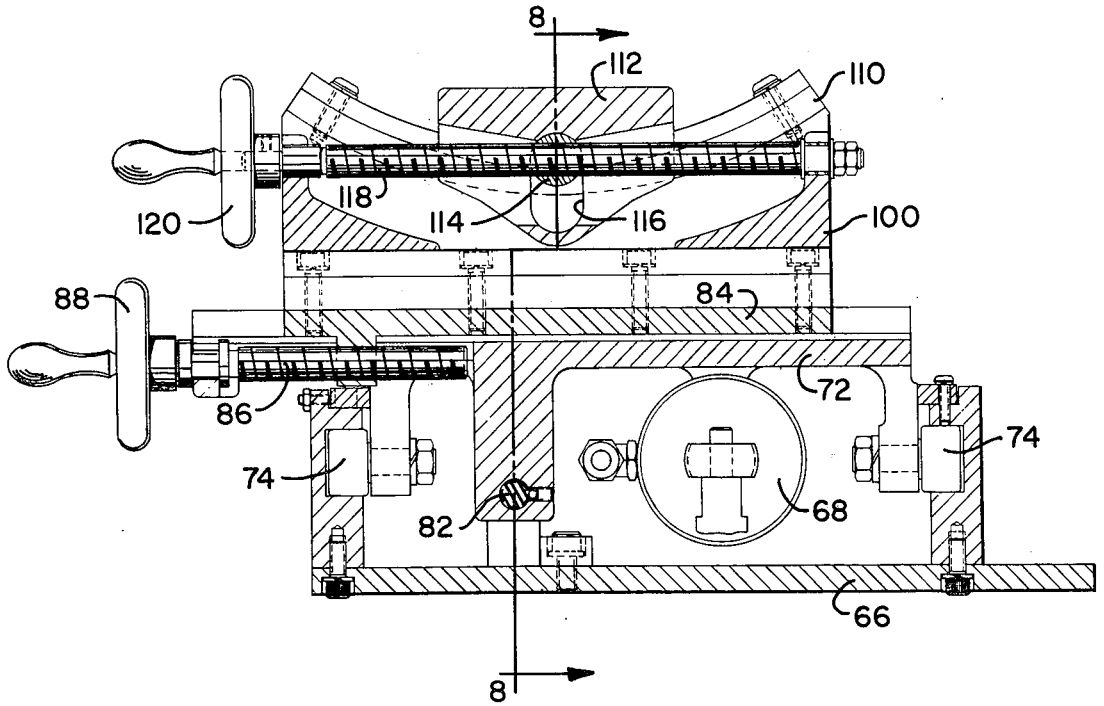
FIG. 7 is a section taken along the line 7—7 of FIG. 6.
Figure 8:
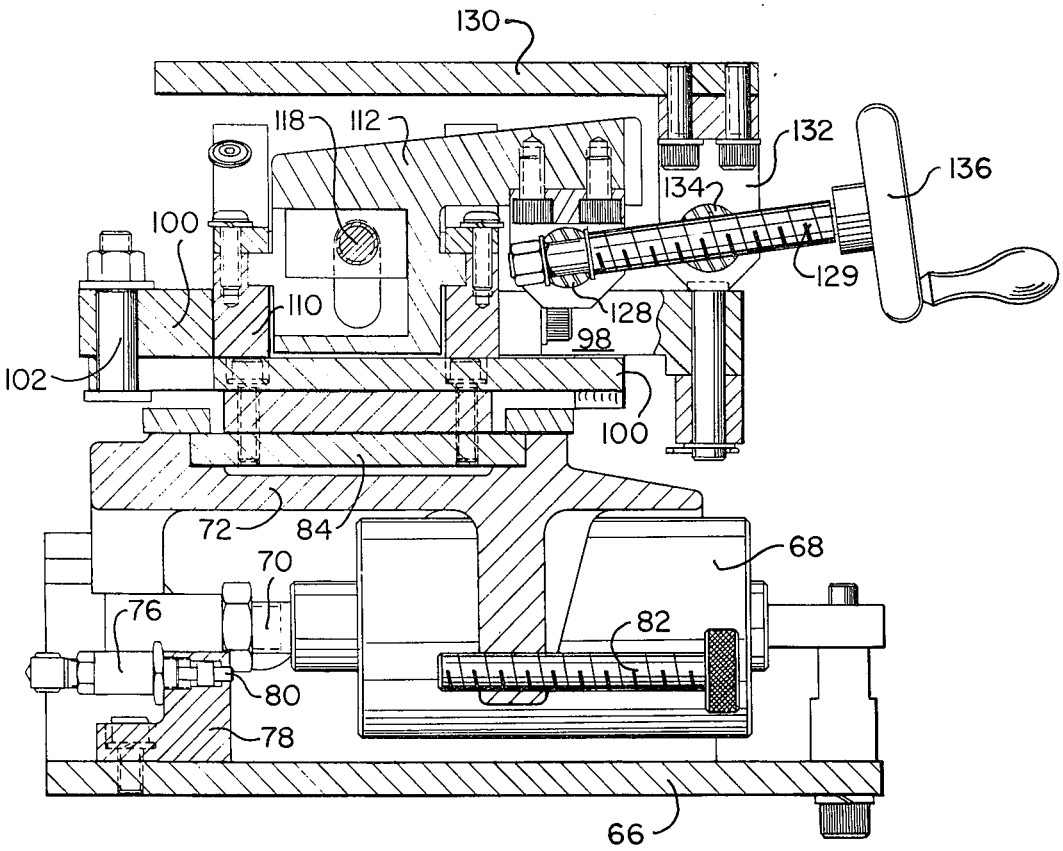
FIG. 8 is a section taken along the line 8—8 of FIG. 7.

The operator is intended to stand in front of the machine as seen in FIG. 1 and to the right of the machine as seen in FIG. 2. Directions extending toward the operator (left to right in FIG. 2) will be designated as "forward" and directions extending away from the operator (right to left in FIG. 2) will be designated as "rearward". The front of the machine is closest to the operator and the back of the machine is furthermost from the operator. Referring to FIGS. 3 and 4, the machine frame includes a bracket 10 having flanges 12 bolted thereto. A housing 14 is pivoted to the flanges 12 by means of a pivot pin 16 for swinging movement about the vertical axis of the pin 16. A sleeve 18 is located on the housing 14 forwardly of the pivot pin 16. An upwardly and forwardly inclined last pin 20 is secured to the top of a bar 22 that is mounted for heightwise movement in the sleeve 18. A flange 24 is mounted to the front of the bar 22 by means of screws 26 that connect the flange 24 and the bar 22 and that extend through slots 28 in the sleeve 18. A plate 30 is mounted to and extends forwardly of the flange 24.

A column 32 is mounted to and extends upwardly of the plate 30 by spaced legs 34 (FIG. 1) and an air operated motor 36 is mounted to and extends upwardly of the plate 30 between the legs 34. The piston rod 38 of the motor 36 is secured to a post 40 and the post 40 is mounted for heightwise movement in the column 32. A toe rest 42 is mounted to the top of the post 40 and is located forwardly of the last pin 20. A screw 44, threaded into a flange 46 that is bolted to the post 40, is in alignment with a lug 48 that is anchored to the column 32.

A pair of forwardly directed wings 50 are mounted to the housing 14 and are located on opposite sides of a cam 52. The cam 52 is mounted to a bracket 54 for forward-rearward adjustment and the bracket 54 is secured to a cross-piece 56 of the machine frame. An air actuated motor 58, pivoted to the bracket 10, has a forwardly directed piston rod 60 that is pivoted to a lug 62 of the housing 14.

The last pin 20 and the toe rest 42 constitute a work support 64 for supporting a shoe assembly that is described below.

Duplicate side lasting mechanisms 65 are located on opposite sides of the work support 64 (see FIG. 1). Referring to FIGS. 1, 2 and 5–8, each lasting unit 65 includes a table 66 that is mounted to the machine frame on each side of the work support 64. An air actuated motor 68, mounted to each table 66, has a piston rod 70 that is secured to a frame 72. Each frame 72 is mounted to its associated table 66 for inward-outward movement by means of rollers 74. A valve 76 is mounted to a bracket 78 that is secured to each table 66. The outwardly facing stem 80 of each valve 76 is in registry with a rod 82 that is mounted to its associated frame 72.

A sled 84 is mounted to each frame 72 for forward-rearward movement. A shaft 86 is rotatably mounted to each frame 72 and is threaded into its associated sled 84. A handle 88 is secured to each shaft 86 whereby rotation of each handle 88 effects forward-rearward adjustment of its associated sled 84 with respect to its associated frame 72.

An air operated motor 90 is pivotally mounted to the sled 84 by a pin 92 and extends rearwardly of the pin 92. The piston rod 94 of the motor 90 is pivotally connected by a pin 96 to a lug 98. The lug 98 is secured to and extends outwardly of a housing 100. The housing 100 is pivoted to the sled 84 by a pivot pin 102 for arcuate movement about the axis of the pin 102, the pin 102 being located at the inner rear portion of the sled 84. Forwardly of the pin 102, a pin 104 in the housing 100 is movable in an arcuate slot 106 in the sled 84, the center of curvature of the slot 106 coinciding with the axis of the pin 102. A stud 108, mounted to the sled 84, is located rearwardly of and in registry with the lug 98.

An upwardly concave track 110 in each housing 100, that extends in forward-rearward directions, slidably mounts a bracket 112. A pin 114 is mounted in each bracket 112 for heightwise movement in a slot 116. Each pin 114 threadedly receives a bolt 118 that is rotatably mounted to its associated housing 100. A handle 120 is mounted to the front of each bolt 118 so that rotation of each handle 120 can effect forward-rearward movement of its associated bracket 112 in the arcuate path of the track 110.

A brace 122 is secured to and extends upwardly of the outer front and back portions of each bracket 112. The top of a limb 124 is pivoted to the top of each brace 122 by a pin 126. A pin 128, rotatably mounted in each bracket 112, rotatably mounts a bolt 129 that extends outwardly of its associated bracket 112. A base 130 is secured to and extends between each pair of limbs 124, the bases 130 overlying the brackets 112. A lug 132, that is secured to and depends from the outer end of each base 130, rotatably mounts a pin 134. Each pin 134 threadedly receives its associated bolt 129. A handle 136 is secured to the outer end of each bolt 129 whereby rotation of each handle 136 can effect heightwise movement of its associated base 130 about the axis of its associated pins 126.

Figure 9:
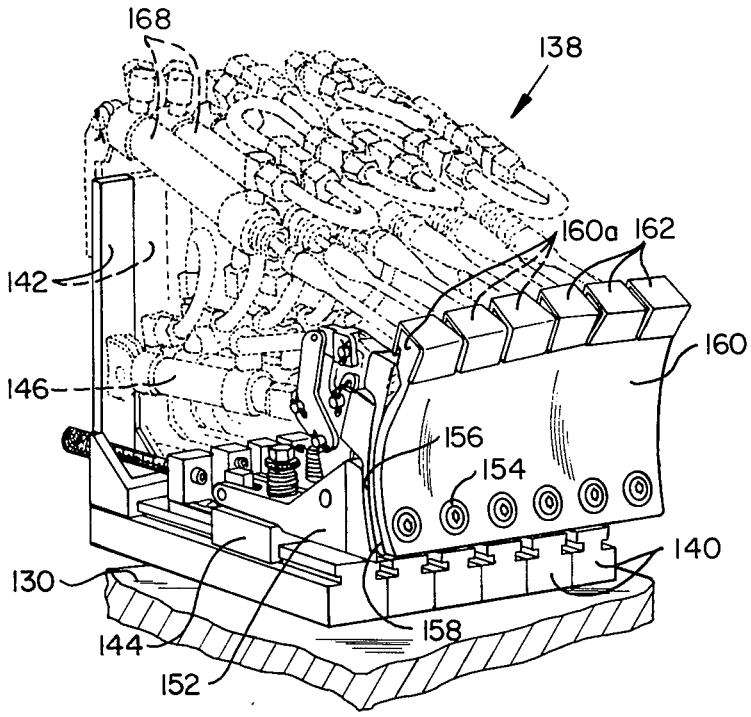
FIG. 9 is an isometric view of a side lasting instrumentality.
Figure 10:
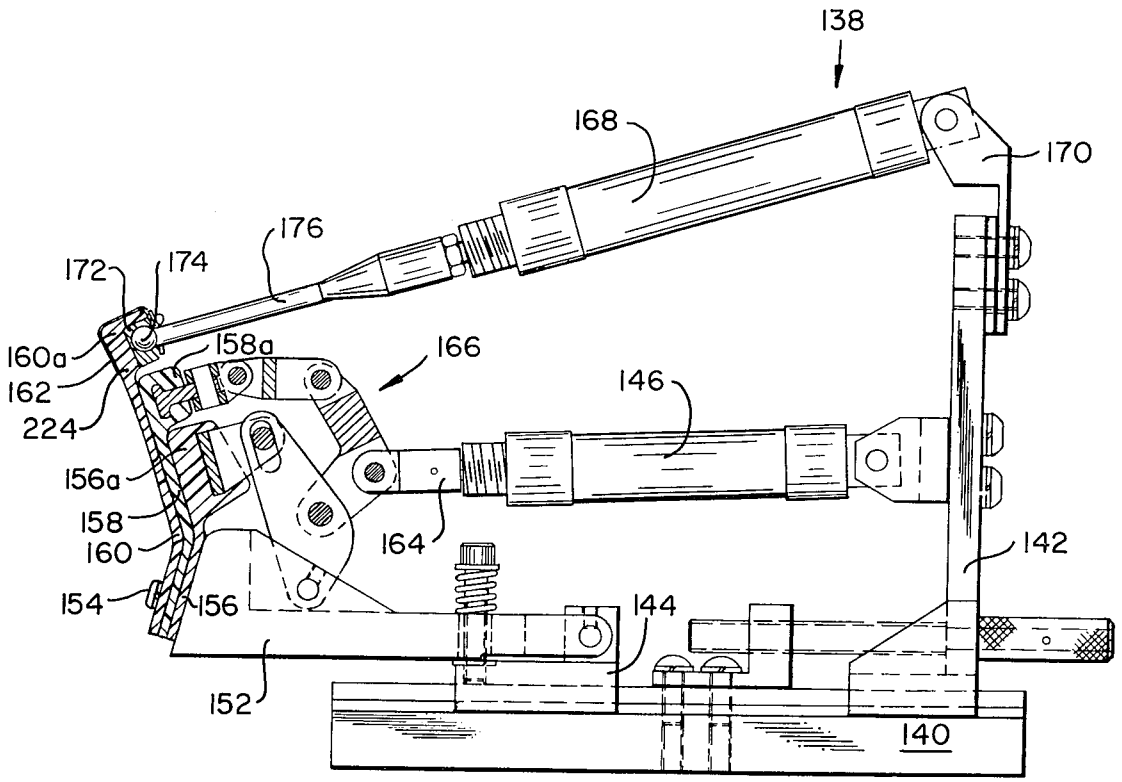
FIG. 10 is a partially sectional view of a side lasting instrumentality.

Referring to FIGS. 9 and 10, each side lasting mechanism 65 comprises a side lasting instrumentality 138 that is mounted to each base 130. The side lasting instrumentalities 138 are constructed similarly to the side lasting instrumentalities desclosed in applications Ser. Nos. 467522 and 530927. Each side lasting instrumentality 138 comprises a plurality of supports 140 that are located side by side on each base 130. An outer bracket 142 is mounted to and extends upwardly of each support 140. An inner slide bracket 144 is mounted to each support 140, inwardly of its associated outer bracket 142, for inward-outward movement. An air operator motor 146 is pivoted to each outer bracket 142 and extends inwardly thereof. A block 152 is mounted to each inner slide bracket 144.

Three plies of material are anchored to each block 152 by bolts 154. The outer ply is a separate outer presser strap 156 for each support 140, the middle ply is a separate inner presser strap 158 for each support 140, and the inner ply is a single lasting strap 160. The straps 156, 158 and 160 are made of an elastic, flexible and deformable material such as urethane. The top of the lasting strap 160 is formed into a plurality of rigid top segments **160*a*. A relatively rigid metal clip 162 is secured to each segment 160*a* so as to bear against the inner face of the segment 160*a*. The top of each inner presser strap 158 is formed into a thickened relatively rigid top segment 158*a* that is located below its associated lasting strap top segment 160*a*. The top of each outer presser strap 156 is formed into a thickened relatively rigid top segment 156*a* that is located below its associated inner presser strap top segment 158*a***.

The piston rod 164 of each motor 146 is connected to its associated outer presser strap 156 and inner presser strap 158 by a linkage 166 that is described in greater detail in applications Ser. Nos. 467522 and 530927.

An air operator motor 168 is associated with each top segment **160*a*. Each motor 168 is pivoted to a bracket 170 that is secured to the top of each outer bracket 142 with the motors 168 extending inwardly of the brackets 170. A socket 172 is embedded in each lasting strap top segment 160*a*. Each socket 172 rotatably receives a ball 174 that is mounted to the inner end of the piston rod 176 of its associated motor 168 to thereby provide flexible connections between the piston rods 176 and the lasting strap top segments 160*a***.

Referring to FIGS. 1 and 2, a platform 178 is located rearwardly of the work support 64 and the side lasting mechanisms 65. A heel lasting mechanism 180, as disclosed in applications Serial Nos. 467522 and 530927, is mounted to the platform 178. The heel lasting mechanism includes a heel clamp 182 and a pair of heel wipers 184, the heel wipers 184 being symmetrically disposed about the forward-rearward axis of the machine and being located above the heel clamp.

In the idle condition of the machine: the motor 36 causes the piston rod 38 to move upwardly to thereby resiliently urge the toe rest 42 upwardly under the force of pressurized air in the motor 36; the piston rods 70 are retracted into the motors 68 to thus force the bases 130 into outer positions and thus position the side lasting mechanisms 65 in outer positions wherein they do not interfere with the placement of a shoe assembly on the work support 64 as described below; and the piston rods 164 are retracted into the motors 146 and the piston rods 176 are retracted into the motors 168 thus placing the side lasting instrumentalities 138 in outer positions on the supports 140. In the idle positions of the side lasting instrumentalities 138, the back end of each lasting strap 160 is in approximate vertical registry with its associated pivot pin 102.

Figure 11:
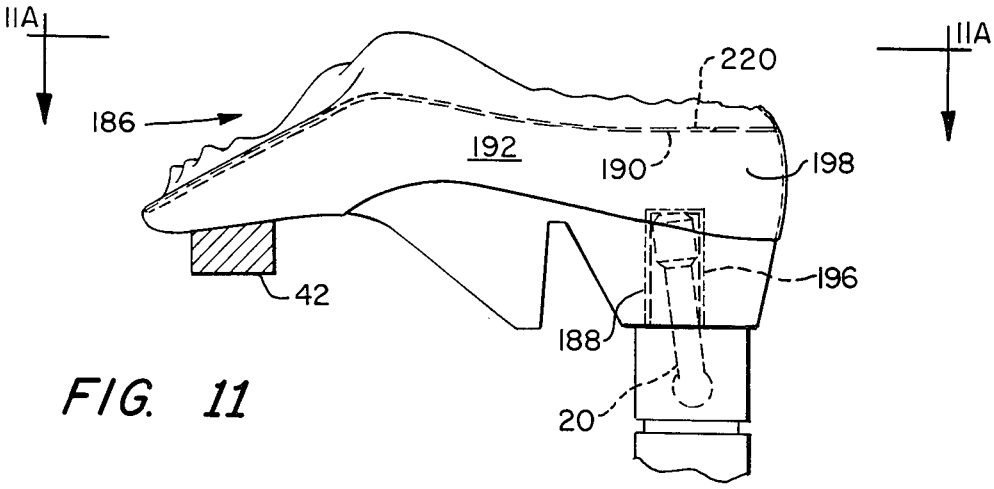
FIG. 11 is a side view of the shoe assembly as it appears in the machine at the beginning of a machine cycle.
Figure 11A:
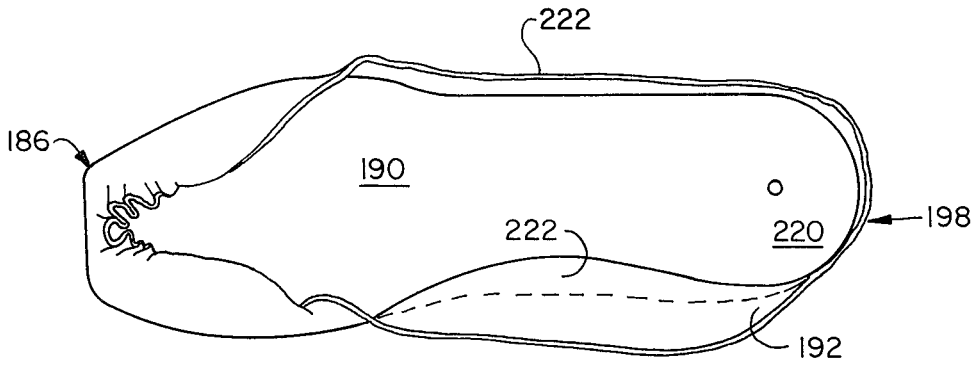
FIG. 11A is a view taken along the line 11A—11A of FIG. 11.

A shoe assembly 186 (FIGS. 11 and 11A) comprising a last 188 having an insole 190 located on its bottom and an upper 192 mounted thereon is placed bottom-up on the work support 64 with the vamp of the shoe assembly resting on the toe rest 42 between upstanding toe rest flanges 194 (FIG. 1) and with the last pin 20 inserted into the thimble 196 in the back portion of the last so that the toe of the shoe assembly faces forwardly. The hole in the thimble 196 in which the last pin 20 is inserted has a greater inner diameter than the outer diameter of the last pin to thereby provide play between the last pin and the shoe assembly 186. The inclined last pin engages the front of the hole in the thimble 196. Prior to placement in the machine, the shoe assembly 186 had been toe lasted. In FIGS. 11 and 11A, the shoe assembly is illustrated as being for a left foot and the machine operating cycle described below will be for a left foot shoe assembly.

At the start of the machine cycle, the operator causes the motor 58 to be so operated as to retract its piston rod 60 and thereby swing the work support 64 rightwardly as seen in FIG. 1 and counterclockwise as seen in FIG. 4 about the axis of the pivot pin 16 until the wing 50 on the left side of the machine as seen in FIG. 1, which is the upper wing 50 as seen in FIG. 4, engages the cam 52. The cam 52 had been so adusted in forward-rearward directions that the periphery of the heel portion 198 of the left foot shoe assembly 186 is symmetrical about the forward-rearward line of symmetry 200 (see FIG. 12) of the machine and of the heel wipers 184 when the wing 50 referred to in the preceding sentence engages the cam 52. This symmetrical relationship ensures that the heel wipers 184 will efficiently perform the heel wiping operation described below. The axis of the pin 16, about which the work support 64, together with the shoe assembly 186, is swung by the motor 58 is in approximate coincidence with the heel end extremity of the shoe assembly, thus ensuring that the periphery of the heel portion 198 of the shoe assembly 186 is in the desired symmetrical location when it has completed its swing about the axis of the pin 16 for the left foot shoe assembly as described here and for the right foot shoe assembly as described below.

Figure 12A:
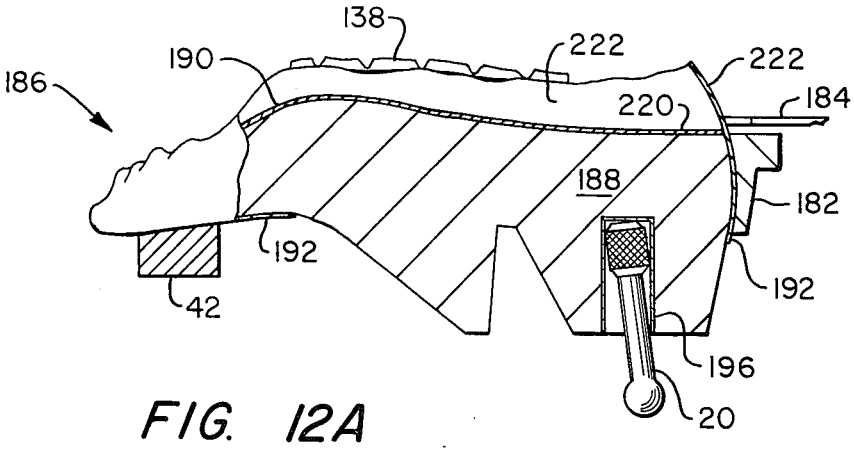
FIG. 12A is a section taken along the line 12A—12A of FIG. 12.
Figure 12:
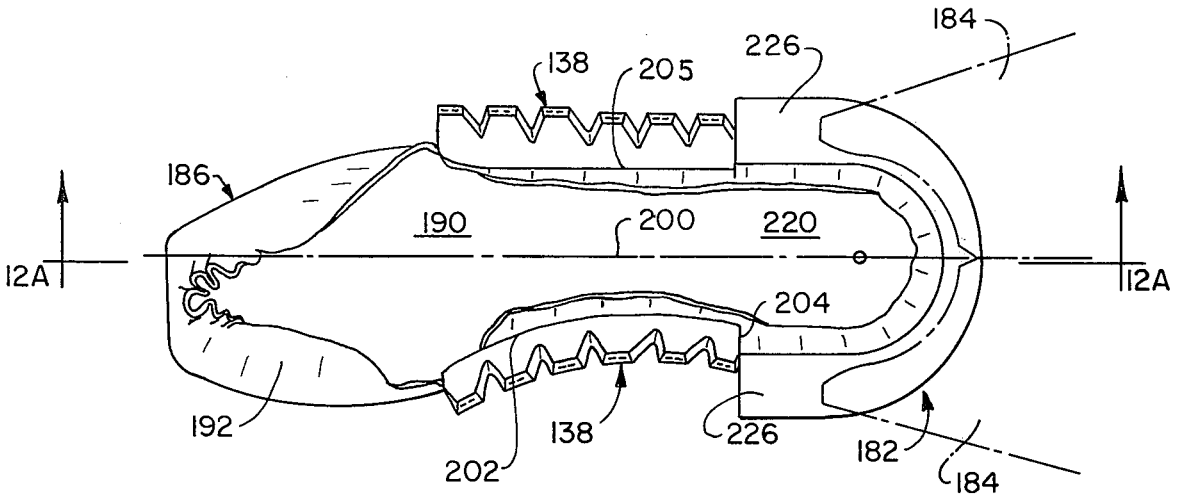
FIG. 12 is a plan view of the shoe assembly as it appears in the machine after the side and heel portions of the upper have respectively been clamped to the last by the side lasting instrumentalities and a heel clamp.

When the shoe assembly has been brought into the symmetrical relationship referred to in the preceding paragraph, the right side shank portion 202 (the bottom portion as seen in FIG. 12) of the shoe assembly 186 diverges away from the line of symmetry 200 as this shank portion extends toewardly from the breast line 204 on the right side of the shoe assembly and the left side shank portion 205 is substantially parallel to the line of symmetry 200. At the start of the machine cycle, the motor 90 on the right side of the machine as seen in FIG. 1 is actuated to project its piston rod 94 rearwardly to thereby swing the associated lug 98 rearwardly about the axis of the associated pivot pin 102 until this lug 98 engages the associated stud 108 and thereby swing the associated side lasting instrumentality 138 about the axis of the associated pivot pin 102, with the associated pin 104 moving in the associated slot 106, to a position wherein the lasting strap 160 of the associated side lasting instrumentality is approximately parallel to the shank portion 202. Also, at the start of the machine cycle, the motor 90 on the left side of the machine is actuated to retract its piston rod forwardly into this motor 90 to thereby swing the associated lug 98 forwardly about the axis of the associated pivot pin 102 to the extent permitted by this motor 90 and thereby swing the associated side lasting instrumentality 138 about the axis of the associated pivot pin 102, with the associated pin 104 moving in the associated slot 106, to a position wherein the lasting strap 160 of the associated side lasting instrumentality 138 is approximately parallel to the shank portion 205.

Referring to FIGS. 3 and 4, the bar 22, together with the support 64, is connected to the piston rod 206 of an air actuated motor 208 that is mounted to the housing 14. A brake plate 210 is connected to the bar 22 for heightwise movement therewith and is located between a pair of brake arms 212 that are pivotally mounted on levers 214. The levers 214 are pivoted to the housing 14 by means of pins 216. The back end of one of the levers 214 is pivotally connected to the piston rod of an air actuated motor 218 and the back end of the other lever 214 is pivotally connected to the cylinder of the motor 218.

In the manner disclosed in application Ser. No. 467522, the motor 208 is now actuated to raise the bar 22, together with the support 64, to a position wherein the insole heel seat portion 220 (FIGS. 12 and 12A) is located substantially level with the bottoms of the heel wipers 184 in a plane substantially parallel to the plane of movement of the heel wipers 184 as shown in FIGS. 12 and 12A. After this the motor 218 is actuated to force the brake arms 212 against the brake plate 210 to thereby lock the bar 22 and the support 64 in this position. This is followed by a forward movement of the heel clamp 182 and the wipers 184 forwardly from an initial rearward out-of-the-way position to the forward working position shown in FIGS. 12 and 12A wherein the heel clamp engages the heel portion 198 of the shoe assembly 186 and clamps the heel portion of the upper 192 against the last and wherein the heel wipers 184 are close to but not in engagement with the heel portion of the margin 222 of the upper 192.

At about the same time as the heel clamp 182 and the heel wipers 184 are brought to the FIGS. 12 and 12A position, the motors 68 are so actuated as to project their piston rods 70 inwardly to thus move the bases 130, together with the side lasting instrumentalities 138, inwardly to positions wherein the rods 82 engage the brackets 78 and push the valve stems 80 to thereby shift the valves 76. As a result, the side lasting instrumentalities 138 are positioned close to but not in engagement with the side of the shoe assembly 186. Due to the swinging of the lasting instrumentalities 138 by the motors 90 about the vertical axes of the pins 102, which axes are in approximate registry with the back ends of the lasting straps 160, the lasting straps 160 are now also approximately parallel to their associated side or shank portions of the shoe assembly 186.

The shifting of the valves 76 so operates the motors 146 and 168, in the manner shown in U.S. Pat. No. 3775797, as to bring the lasting instrumentalities 138 to the FIG. 13 position wherein the lasting straps 160 are pressing the side portions of the upper 192 against the side portions of the last 188 with the relatively rigid lasting strap top segments 160a extending upwardly of the insole 190 and bearing against the side portions of the upper margin 222. Each top segment 160*a* at this time is folded partway towards the insole 190 under a relatively low back up force applied by a motor 168 as shown in U.S. Pat. No. 3775797 to form an acute angle with the insole and thus fold the side portions of the upper margin 222 partway towards the insole.

The shoe assembly engaging parts are now in the position shown in FIGS. 12 and 12A with the heel clamp 182 pressing the heel portion of the upper 192 against the last 188 and the side lasting instrumentalities 138 pressing the side portions of the upper against the last, the side lasting instrumentalities 138 being located forwardly of the heel clamp 172 with substantially no space between the rears of the side lasting instrumentalities 138 and the fronts of legs 226 (FIG. 12) of the clamp 182.

Now, in the manner desclosed in application Ser. No. 467522, nozzles 228 (FIGS. 1, 2 and 13) are caused to travel rearwardly in the corners between the upper margin 222 and the periphery of the insole 190 from the boundaries between the wiper toe portion of the upper margin and the unwiped side portions of the upper margin to the heel end extremity of the shoe assembly 126 while cement is extruded from the nozzles into these corners. The nozzles 228 travel of lengthwise of the shoe assembly while being urged outwardly against the upper margin. The cement is extruded from the nozzles during their travel along the insole periphery, the cement inserted into the angle between the upper margin 222 and the insole 190. The relatively low back-up force exerted against the upper margin 222 by the lasting strap top segments 160*a* forces the upper margin against the periphery of the insole 190 to create a barrier between the upper margin and the insole that inhibits the creeping of the cement between the upper margin and the insole and then between the upper 192 and the sides of the last 188. In addition, the force exerted against the upper margin under the relatively low pressure by the lasting strap top segments 160*a* into the FIG. 13 position enables these top segments fo serve as back-up members to limit the extent of outward movement of the nozzles 228 during their travel along the insole periphery.

Figure 13:
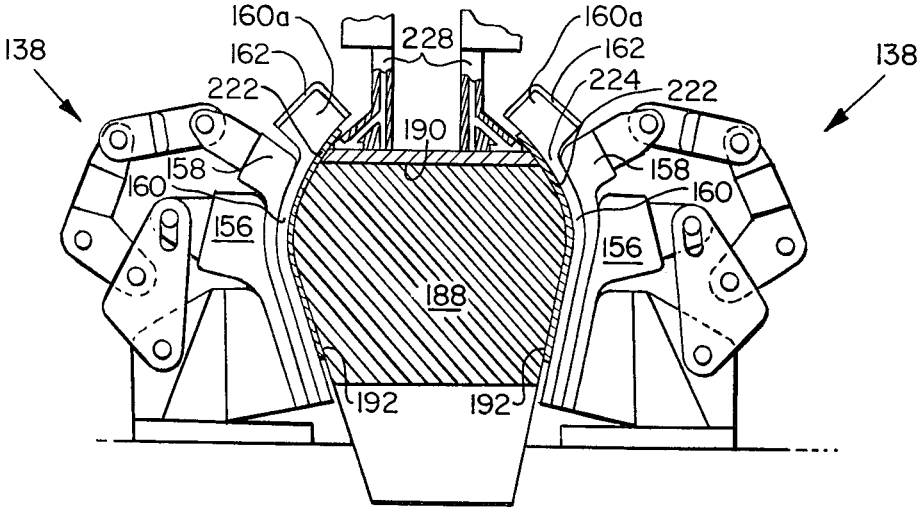
FIG. 13 is a view showing nozzles as they appear when applying cement into the corners between the side portions of the upper margin and the corresponding portions of the insole periphery.

It is desirable that the upper margins be not folded so far towards the insole by the top segments 160*a* as to prevent the nozzles 228 from reaching into the corners between the periphery of the insole 190 and the upper margin 222 during the travel of the nozzles. In order to prevent this undesirable condition from happening the junctures 224 (FIG. 10) between the relatively rigid lasting strap top segments 160*a* and the relatively flexible remainders of the lasting straps 160 should be located below the upwardly facing bottoms of the insole peripheral portions that are proximate to the lasting straps as shown in FIG. 13. In order to accomplish this and to ensure that the lasting straps 160 are facing the shank portions 202 and 205 of the shoe assembly prior to engaging the shoe assembly, the following adjustments were made by the operator, in dependence on the particular size and style of shoe assembly being operated on:

a. The handles 88 were rotated to move the lasting instrumentalities 138 forwardly or rearwardly;

b. The handles 120 were rotated to move the lasting instrumentalities along the tracks 110, the center of curvature of the tracks 110 being substantially at the tops of the forward-rearward midportions of the lasting straps 160; and c. The handles 136 were rotated to effect a heightwise adjustment of the lasting instrumentalities 138.

After the cement has been applied by the nozzles 228 as set forth above, pressurized air is applied by the motors 168 against the lasting strap top segments 160a under relatively high pressure so as to cause the top segments to move inwardly from the FIG. 13 position and down against the insole 190 to cause the clips 162 to wipe or fold the side portions of the upper margin 222 against the insole 190 in side wiping operations and thus bond these portions of the upper margin to the insole by means of the previously applied cement.

During the side wiping operations, the junctures 224 between the relatively rigid top segments 160*a* and the relatively flexible remainders of the lasting straps 160 should be substantially level with the peripheral portions of the upwardly facing bottom of the insole 190 that are proximate thereto. In order for this condition to take place, during the side wiping operations the lasting strap top segments 160a force the portions of the shoe assembly they engage downwardly against the upwardly directed yieldable force of the motor 36 to thereby force the toe rest downwardly until the junctures 224 are substantially level with their proximate periphal portions of the insole 190. During this downward movement of the side and toe portions of the shoe assembly 186, the front of the hole in the thimble 196 moves forwardly of the inclined last pin 20 and the planar movement of the insole heel rest 220 with respect to the bottoms of the heel wipers 184 is inconsequential. The last pin 20 acts as a fulcrum about which the shoe assembly 186 tilts during the side wiping operations, the portion of the shoe assembly located toewardly of the last pin 20 tilting downwardly and the portion of the shoe assembly located heelwardly of the last pin 20 tilting upwardly. As is clear from FIG. 12A, the side lasting instrumentalities are located toewardly of the last pin 20 to enable all of the segments 160*a* to force their associated portions of the shoe assembly downwardly during their side wiping operations. The clamping pressure of the heel clamp 182 against the heel portion 198 of the shoe assembly 186 is not great enough to preclude this tilting of the shoe assembly about the last pin 20.

After the lasting strap top segments 160*a* forced the side portions of the upper margin 222 against the insole 190 for a sufficient length of time as to enable the side portions of the upper margin to be effectively bonded to the insole, the motors 68, 146 and 168 are actuated to return the side lasting mechanisms 65 to their idle positions. This is followed, in the manner disclosed in applications Ser. Nos. 467522 and 530927, by a movement of the heel wipers 184 in a heel wiping stroke wherein the heel wipers 184 move forwardly and inwardly from their FIGS. 12 and 12A position. During their heel wiping stroke, the heel wipers 184 engage the heel portion of the upper margin 222, that extends from the heel end extremity of the shoe assembly 186 to the rearmost ends of the side portions of the upper margin 222 that had previously been wiped against and bonded to the insole by the side lasting mechanism 65, and wipe the heel portion of the upper margin against the insole heel seat portion 220 and bond it to the insole heel seat portion by means of the previously applied cement.

At or near the end of the heel wiping stroke the motor 218 is so actuated as to cause the brake arms 212 to disengage the brake plate 210 and thus unlock the support 64 for heightwise movement. At about the same time, air is introduced under increased bedding pressure to the motor 208 to cause the support 64 to be so forced upwardly as to press the wiped heel portion of the upper margin 222 against the bottoms of the heel wipers 184 to thereby flatten the wiped heel portion of the upper margin and enhance the bond between the heel portion of the upper margin and the insole heel seat portion 220. When this bedding pressure has been applied for a sufficient length of time, the machine parts that have not already done so are returned to their idle positions and the machine cycle is completed so that the lasted shoe assembly 186 can be removed from the machine.

When operating on a right foot shoe assembly, the operator causes the motor 58 to be so operated as to project its piston rod 60 forwardly of the motor 58 and thereby swing the work support 64 leftwardly as seen in FIG. 1 and clockwise as seen in FIG. 4 about the axis of the pivot pin 16 until the wing 50 on the right side of the machine as seen in FIG. 1, which is the lower wing 50 as seen in FIG. 4, engages the cam 52 to thus bring the periphery of the heel portion 198 of the right foot shoe assembly into symmetrical relationship with respect to the heel wipers 184.

When operating on the right foot shoe assembly, the motor 90 on the left side of the machine as seen in FIG. 1 is actuacted to project its piston rod 94 rearwardly and the motor 90 on the right side of the machine is actuated to project its piston rod forwardly to thereby, in the manner described above, swing the lasting instrumentalities 138 about the axes of the pivot pins 102 to bring the lasting straps 160 to positions wherein they are approximately parallel to their associated side or shank portions of the right foot shoe assembly.

In all other respects, the machine cycle in operating on a right foot shoe assembly is identical to the above described machine cycle for operating on a left foot shoe assembly.

There follows a recapitulation of the machine construction and operation that form the basic components of this invention.

The heel wipers 184 constitute heel wiping means that are symmetrically disposed about the forwardly-rearwardly extending line of symmetry 200. The heel wiping means are mounted for forward movement from the retracted position shown in FIGS. 12 and 12A to an advanced position in a heel wiping stroke.

The work support 64 constitutes support means for so supporting bottom-up the shoe assembly 186 that the heel portion 198 of the shoe assembly faces the heel wiping means and is located forwardly of the heel wiping means when the heel wiping means is in its retracted position so that the heel wiping stroke causes the heel wiping means to wipe the heel portion of the upper margin 222 against the insole 190. The support means is so movably mounted as to enable the heel portion of the shoe assembly to be swung transversely of the line of symmetry 200 about the axis of the pin 16 by the motor 58 to thereby place the heel portion of a particular shoe assembly in symmetry with the line of symmetry 200.

A sled 84 is located outwardly of and on each side of the support means and a housing 100 is pivotally mounted to each sled for pivotal movement about the upright axis of a pin 102. A base 130 is so mounted to each housing as to permit pivotal movement of each base together with its associated housing 100 about said axis toward and away from the line of symmetry 200.

A side lasting instrumentality 138 is mounted to each base 130 for inward-outward movement with each side lasting instrumentality extending forwardly of the axis of its associated pin 102. Each side lasting instrumentality is so constructed as to enable it, when it is moved inwardly of an outer position on its associated base, to perform operations on its associated side portion of the shoe assembly 186 that includes engaging its associated side portion of the shoe assembly and wiping the margin 222 of its associated side portion of the upper 192 against the insole 190. Drive means comprised of a motor 90 is interposed between each sled 84 and its associated housing 100 for swinging each base about the axis of its associated pin 102 between a first position wherein its associated side lasting instrumentality extends forwardly and outwardly of the axis of its associated pin 102 and a second position wherein its associated side lasting instrumentality 138 so extends forwardly of the axis of its associated pin 102 that it is located inwardly of said first position.

I claim:

1. A lasting machine comprising: heel wiping means, symmetrically disposed about a forwardly-rearwardly extending line of symmetry, mounted for forward movement from a retracted position to an advanced position in a heel wiping stroke; support means for so supporting bottom-up a shoe assembly, formed of a last having an upper mounted thereon and an insole located on its bottom, that the heel portion of the shoe assembly faces the heel wiping means and is located forwardly of the heel wiping means when the heel wiping means is in its retracted position whereby the heel wiping stroke causes the heel wiping means to wipe the heel portion of the upper margin against the insole, said support means being so movably mounted as to enable the heel portion of the shoe assembly to be swung transversely of said line of symmetry to thereby place the heel portion of a particular shoe assembly in symmetry with said line of symmetry; a base located outwardly of and on each side of the support means; means mounting each base for pivotal movement about an upright axis towards and away from said line of symmetry; a side lasting instrumentality mounted to each base for inward-outward movement and extending forwardly of its associated axis, each side lasting instrumentality being so constructed as to enable it, when it is moved inwardly of an outer position on its associated base, to perform operations on its associated side portion of the shoe assembly that include engaging its associated side portion of the shoe assembly and wiping the margin of its associated side portion of the upper against the insole; and moving means for swinging each base about its associated axis between a first position wherein its associated side lasting instrumentality extends forwardly and outwardly of its associated axis and a second position wherein its associated side lasting instrumentality so extends forwardly of its associated axis that it is located inwardly of said first position.

2. The machine of claim 1 wherein said means mounting each base for said pivotal movement comprises: a sled located outwardly of and on each side of the support means; a housing pivotally mounted to each base for pivotal movement about said axis; and means mounting a base to each of said housings; and wherein said moving means comprises: drive means interposed between each sled and its associated housing.

* * * * *

UNITED STATES PATENT AND TRADEMARK OFFICE

CERTIFICATE OF CORRECTION

PATENT NO. : 3,962,741

DATED : June 15, 1976

INVENTOR(S) : Walter Vonberger

It is certified that error appears in the above-identified patent and that said Letters Patent are hereby corrected as shown below:

Column 7: line 27, change "desclosed" to --disclosed--.
Column 8: line 39, change "rest" to -- seat portion--.

Signed and Sealed this

Twenty-first Day of June 1977

[SEAL]

*Attest:*

RUTH C. MASON
*Attesting Officer*

C. MARSHALL DANN
*Commissioner of Patents and Trademarks*